US005437742A

United States Patent [19]

Siga et al.

[11] Patent Number: 5,437,742

[45] Date of Patent: Aug. 1, 1995

[54] STEEL ROTOR SHAFTS FOR ELECTRIC MACHINES

[75] Inventors: Masao Siga, Hitachi; Mitso Kuriyama, Ibaraki; Takanobu Mori, Hitachi; Yutaka Fukui, Hitachi; Tatsuro Ishizuka, Hitachi, all of Japan

[73] Assignee: Hitachi, Ltd., Tokyo, Japan

[21] Appl. No.: 160,651

[22] Filed: Dec. 2, 1993

Related U.S. Application Data

[63] Continuation of Ser. No. 852,567, Mar. 17, 1992, Pat. No. 5,288,567.

[30] Foreign Application Priority Data

Mar. 20, 1991 [JP] Japan ..... 3-057087

[51] Int. Cl.[6] ..... C22C 38/46

[52] U.S. Cl. ..... 148/335; 310/156; 310/261

[58] Field of Search ..... 310/156, 261; 420/83, 420/109; 148/335, 540, 547

[56] References Cited

U.S. PATENT DOCUMENTS 4,477,280 10/1984 Shiga et al. ..... 420/69

5,108,699 4/1992 Bodnar et al. ..... 420/109

*Primary Examiner*—Deborah Yee

*Attorney, Agent, or Firm*—Antonelli, Terry, Stout & Kraus

[57] ABSTRACT

New low-alloy steel compositions and rotor shafts for electric machines made from them are described. High nickel and chromium contents ensure high strength and toughness, while other components, notably silicon and other impurities, are kept low with the result that magnetic properties remain good. One aspect provides a steel with the following proportions by weight:

C 0.15 to 0.3%
Si <0.1%
Mn <1%
Ni 3 to 5%
Cr >2%, <3.5%
(Mo+W) 0.1 to 1.0%, W being optional
V 0.03 to 0.35%, and the remainder substantially Fe.

Other aspects are also described.

12 Claims, 12 Drawing Sheets

STEEL ROTOR SHAFTS FOR ELECTRIC MACHINES

This application is a Continuation application of application Ser. No. 852,567, filed Mar. 17, 1992, now U.S. Pat. No. 5,288,567.

FIELD OF THE INVENTION

This invention relates to steel compositions, rotor shafts for electric machines made from such steels, generators comprising such shafts and methods for making the steels.

BACKGROUND OF THE INVENTION

In recent years, energy production has experienced a shift from petroleum towards coal as a source of thermal power. As a result, one technical problem which has arisen is the need to make turbine generators of increasing effectiveness. Because space is usually limited, the capacity of each individual generator tends to increase.

The rotor shafts of large electric generators are made of steel. Such shafts are very special objects. The shafts for the new generation of large thermal power plants, some of which are envisaged to output as much as 1,000 MW or more, may weigh of the order of 80 tonnes. They must withstand fast rotation, and yet remain operational for a period measured in decades.

Therefore, very high strength and very high toughness are needed. It is well known that high strength tends to cause low toughness, and vice versa. That is one problem. Furthermore, because of the use of the material, it needs to have suitable magnetic properties.

DISCUSSION OF THE PRIOR ART

ASTM Standard Specification A469-88 describes types of special steel which are presently used for generator rotor shafts. Classes 6, 7 and 8 are the strongest. These specify contents as follows:

C less than 0.28%
Mn less than 0.60%
less than 0.015%
Si 0.15 to 0.30%
Ni 3.25 to 4.00%
Cr 1.25 to 2.00%
Mo 0.30 to 0.60%
V 0.05 to 0.15% and the remainder substantially Fe.

The Class 8 steel is the strongest of all, having tensile strength of 84 kg/mm$^2$, 0.02% yield strength of 70.4 kg/mm$^2$, elongation of more than 16%, reduction of area of more than 45% and 50% fracture appearance transition temperature (FATT) below 4° C.

In the patent literature, JP-B-47/25248 describes a low alloy steel for generator rotor shafts having the composition C 0.14 to 0.20%
Si 0.05 to 0.4%
Mn 0.1 to 0.6%
Ni 1.5 to 2.8%
Cr 0.75 to 1.8%
Mo 0.1 to 0.5%
V 0.01 to 0.12% and the remainder is Fe.

JP-A-60/230965 describes low alloy steels for turbine generator shafts, having a composition C 0.13 to 0.30%
Si<0.10%
Mn 0.06 to 2.00%
P<0.010%
Cr 0.40 to 2.00%
Ni 0.20 to 2.50%
Mo 0.10 to 0.50%
V 0.05 to 0.15%
Al 0.005 to 0.040%
N 0.0050 to 0.0150%
Ni+2Mn+2Cr=4 to 8%, the remainder being Fe.

The existing steels are good, but they are not good enough for the new large generators which are envisaged. For example, we have calculated that, for a 900 MVA class generator the rotor shaft material will require a tensile strength of at least 93 kg/mm$^2$, 0.02% yield strength of at least 74 kg/mm$^2$, FATT of below 0° C., and a magnetic characteristic such that magnetic field strength at 21 kG is less than 990 AT/cm. For a 1200 MVA generator rotor shaft, the calculated tensile strength is at least 100 kg/mm$^2$, and for a 1300 MVA generator rotor shaft, at least 104 kg/mm$^2$.

It will be appreciated that, for example, the ASTM Class 8 material mentioned above is quite inadequate for making a rotor shaft material for such generators. Firstly, it is not strong enough. Furthermore, as strength is intensified, toughness (which can be gauged by FATT) tends to decrease. Hence none of the known recipes leads the way to satisfying these new requirements.

SUMMARY OF THE INVENTION

The general object addressed herein is to provide new steel compositions, rotor shafts made from the steel compositions, and preferably steel compositions of improved strength and toughness with good magnetic properties, more preferably meeting the new criteria mentioned above.

As a result of studies, the inventors have discovered certain ways in which high strength and toughness can be achieved, without compromising the magnetic properties. They have been able to prepare steels which satisfy even the preferred criteria set out above.

The invention provides a low alloy steel, and also a rotor shaft made from said steel, having the composition C 0.15 to 0.3%
Si<0.1%
Mn<1%
Ni 3 to 5%
Cr>2%, >3.5%
(Mo+W) 0.1 to 1.0%, W being optional
V 0.03 to 0.35%, and the remainder substantially Fe.

In particular, this composition has higher chromium than has been used in this field in the prior art. It has previously been believed that steel containing more than 2% chromium will have inadequate magnetic properties. The present inventors have found that if one or more other components are kept below specified limits, the chromium content can be increased (thereby improving hardness and toughness) without spoiling the magnetic properties. In particular, this aspect specifies less than 0.1% of silicon in the composition.

The manganese content is also quite low: less than 1% and preferably less then 0.5%.

Reduction in certain other constituents has also been found to have useful significance. In a further aspect, the invention provides a steel, or a rotor shaft made from such steel, having a composition C 0.15 to 0.3%
Si<0.3%
Mn<1%
Ni 3 to 5%
Cr 1.5 to 3.5%
(Mo+W) 0.1 to 1% (W being optional)
V 0.03 to 0.35%
Al<0.01%
(P+S+Sn+Sb+As)<0.03% and the remainder substantially Fe.

The inventors have found that pronouncedly low levels of aluminum, and of the sum total of the impurities phosphorus, sulphur, tin, antimony and arsenic, are also conducive to good properties. Indeed, if these values are kept low the content of silicon can be allowed to be higher than that in the first aspect, while still achieving the use of a relatively high chromium content without damaging magnetic properties.

The content of aluminum is preferably less than 0.006%.

The total content of the five impurity elements mentioned is most preferably not more than 0.01%, and the product of the silicon concentration and that of said five impurities is preferably not more than 0,003.

The ratio between nickel and chromium also has significance for the strength and toughness of the material. The ratio Ni:Cr is preferably less than 2.3, more preferably less than 2.1, more preferably less than 2.05.

The preferred structure for the steel is a uniform bainite structure, containing little or no ferrite.

In another aspect, we provide a high-strength, low alloy Ni—Cr—Mo—V steel, or a rotor shaft made thereof, having a chromium content of 2 to 3.5% by weight, an Al content of less then 0.01% by weight, and in which the product of the weight percentages of silicon and the five impurities mentioned above is not more than 0.003, the steel having a tensile strength at room temperature of at least 93 kg/mm$^2$, a 50% fracture appearance transition temperature (FATT) below 0° C., 0.02% yield strength of at least 74 kg/mm$^2$, and magnetic field strength at 21 kG less than 990 AT/cm.

In a further aspect, the invention provides a rotor shaft for an electric machine, made from a Ni—Cr—Mo—V alloy steel having a tensile strength at room temperature of at least 93 kg/mm$^2$, a 50% fracture appearance transition temperature (FATT) below 0° C., 0.02% yield strength of at least 74 kg/mm$^2$, and magnetic field strength at 21 kG less than 990 AT/cm.

In a further aspect, the invention provides a method of making one of the steel compositions as described, comprising melting in air;
vacuum ladle refining or electroslag remelting;
casting and hot forging;
quenching at 800° C. to 900° C., and
tempering at 525° C. to 650° C. for at least 10 hours.

Preferred features, technical concepts relating to the invention, and applications thereof are now described in some detail.

DETAILED DESCRIPTION

Figure 1:
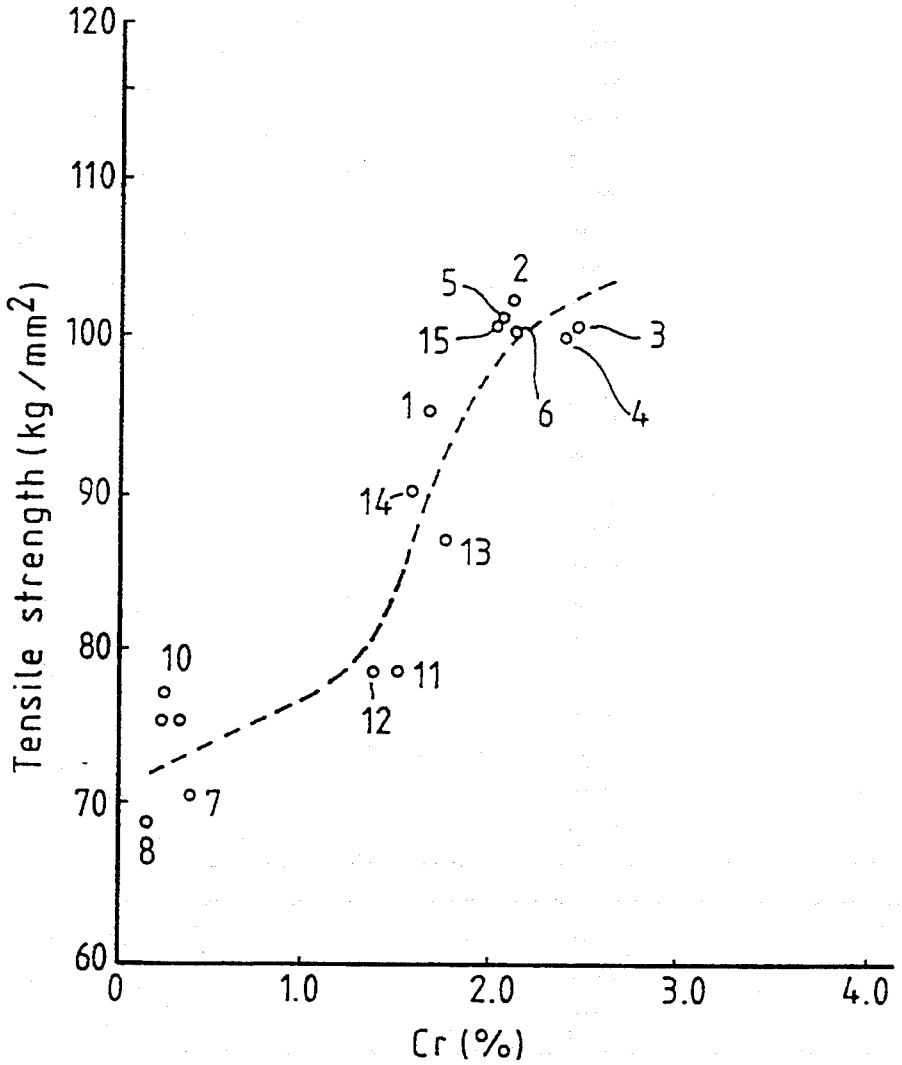
FIG. 1 is a graph showing a relationship between chromium content and tensile strength

Firstly, the steel composition is discussed with reference to the various individual components thereof.

CARBON

Carbon is an element necessary for improving hardenability, necessary for strength. If less than 0.15% is present, insufficient hardenability is achieved and soft ferrite structure tends to form around the steel article so that insufficient tensile strength and yield strength are achieved. With more than 0.3%, toughness is reduced. Hence the carbon content is 0.15 to 0.3%, or preferably 0.20 to 0.28%.

SILICON AND MANGANESE

Conventionally, these elements have been added as deoxidizers. However, new steel-making technology such as the carbon deoxidising process using vacuum ladle refining, and the electroslag re-melting process, have obviated the need for such elements in making a sound article. To prevent brittleness due to tempering, the quantities of silicon and manganese should be kept low, preferably less than 0.1% and 1.0% respectively. The more preferred silicon content is less than 0.05%, and that of manganese less than 0.5%, more preferably less than 0.25%, and most preferably less than 0.2%. Silicon is generally contained as an impurity from 0.01 to 0.1%, without the need to add it specially. However it is usually desirable to add some manganese; the quantity. should be at least 0.05%, or preferably at least 0.1%.

In certain circumstances the amount of silicon may be allowed to rise above the level suggested above. See below.

NICKEL

Nickel is essential for improving hardenability and toughness. With less than 3.0%, there is insufficient toughness. If a large amount is used, over 5%, harmful residual austenite structure appears so that the desired uniform tempered bainite is not achieved. Therefore at least 3% is used, preferably at least 3.25% and most preferably at least 3.5%. Conversely, the amount should be less than 5% and preferably less than 4.5%.

CHROMIUM

Chromium has a remarkable effect in improving hardenability and toughness. It also improves the resistance to corrosion. With less than 1.5%, these effects are not sufficient. However more than 3.5% tends to cause residual austenite structure. Usually more than 2% is used, e.g. at least 2.05%, but preferably less than 3% and more preferably less than 2.6%.

MOLYBDENUM

Molybdenum precipitates fine carbide in the crystal grain during tempering, intensifying tensile strength and yield strength by a carbide dispersion strengthening action. It also acts to restrict the segregation of impurities at the crystal grain boundary. It can prevent brittleness due to tempering. At least 0.1% is required to secure these effects. Over 1.0%, however, the effects tend to be saturated. The preferred range is 0.25 to 0.6%, more preferably 0.35 to 0.45%. However, Mo may to some extent be substituted by W: see below.

VANADIUM

Like Mo, V precipitates fine carbide with the same desirable effects. To achieve the effects, at least 0.03% should be used, preferably at least 0.05% and more preferably at least 0.1%. Over 0.35%, the effects tend to be saturated. Not more than 0.2% is preferred, more preferably not more than 0.15%.

ALUMINUM

We have found that excessive quantities of aluminum reduce toughness and desirable magnetic properties. A complete absence of Al completely reduces strength, so at least 0.0005% should be used in making the steel. However, the quantity should be kept low so that toughness and magnetic characteristics are good. Usually, not more than 0.01% by weight should be present. Preferably, not more than 0.006% and more preferably not more than 0.005%.

The relation between Si and Al is not entirely clear as regards embrittlement. However it does seem that, if Si is above 0.1%, Al should be below 0.01%.

OTHER IMPURITIES: P, S, Sn, Sb and As

It is usual for most or all of these to be present as impurities. However they reduce toughness and magnetic characteristics. The total quantity is desirably less than 0.03%, more preferably less than 0.025%. It is difficult to eliminate the elements entirely, but it is particularly desirable to get the total down to less than 0.01%.

We have also found a correlation between the total amount of these impurities, and the amount of Si, as regards the magnetic properties of the steel. A product of the proportion of Si and a value X (the sum of the concentrations of the five above-identified impurities) is preferably less than 0.003, more preferably less than 0.0015.

Ni/Cr

The ratio of these components is related to tensile strength. The ratio should usually be less than 2.3, preferably less than 2.1 and more preferably less than 2.05. The preferred range is 1.2 to 2.05, the more preferred range is 1.4 to 2.05. The Ni content is more than 3%.

GROUP IIa, GROUP IIIa

One or more Group IIa elements (Be, Mg, Ca) and/or one or more Group IIIa elements (Sc, Y, Lanthanides) may be incorporated, in an amount up to 0.1%. These elements have a strong deoxidising effect and can improve toughness and magnetic characteristics. A preferred quantity is 0.001 to 0.05%. The non-radioactive elements are preferable from the point of view of handling.

OTHER ELEMENTS

One or more of Ti, Zr, Hf, Nd, Ta and W may be incorporated, in amounts less than 0.2% by weight, consistent with increasing strength without reducing toughness. A preferred quantity is 0.02 to 0.1%. W acts in the same way as Mo, mentioned above, so W can be substituted for part of Mo.

Thus, the quantity of Mo+W may be 0.1 to 1.0%. The quantity of W is preferably not more than half the total quantity. Mo must be present, but W is optional.

The steel should have tempered bainite structure, and should contain less than 5% ferrite. A uniform, overall structure of bainite is preferred for strength and toughness.

The achieving of good magnetic characteristics relies on reducing one or more of certain impurities.

To reduce silicon considerably, molten metal is obtained by vacuum ladle refining or electroslag re-melting after melting in air. The molten metal is cast in a mould, and hot forged to the desired shape. Subsequently, it is quenched at from 800° to 900° C. and then tempered at 525° to 650° C. for at least 10 hours. The quenching temperature is desirably 30° to 70° C. higher than the point $Ac_3$, most preferably about 50° C. higher. Tempering increases toughness. The preferred temperature is 540° to 625° C., preferably for 10 to 80 hours. After tempering, the final shape is formed by cutting. Cutting generates internal stresses, so stress relief annealing is performed at a temperature below the tempering temperature. Furthermore, homogenising annealing is done at a temperature about 50° C. higher than the quenching temperature, followed by slow cooling.

At the time of quenching, the cooling speed is preferably 50° to 300° C. per hour at the centre of a rotor shaft. This enables formation of bainite structure overall.

As mentioned, the silicon quantity can be set in the range 0.1 to 0.3%, provided that the aluminum quantity is kept below 0.01%. With higher silicon, good characteristics can also be achieved provided that the total quantity of P, S, Sn, Sb and As is kept low, desirably less than 0.025%. The skilled man knows how to reduce the quantities of the latter, although the present importance of this has not previously been disclosed.

ELECTRIC MACHINE FEATURES

Using the previously mentioned alloy steel enables the rotor shaft for electric machines to be made compact by setting the diameter of the body in which a coil is embedded more than lm and the length of the body 5.5 to 6.5 times the diameter. The ratio of less than 5.5 or over 6.5 is not desirable from the viewpoint of vibration. Particularly, 5.6 to 6.0 is desirable.

Although the diameter of the body needs to be enlarged together with the capacity of the generator, it should be less than 0.2 mm per 1 MVA of the capacity plus 1000 mm and over 0.2 mm per 1 MVA plus 900 mm.

Further, the diameter of the body D (m) should be set according to rotation speed (rpm), so that the value of $(D^2 \times R^2)$ is more than $1.0 \times 10^7$. Particularly, the upper limit is desired to be $3.0 \times 10^7$ or more preferably 1.5 to $2.2 \times 10^7$ and most preferably 1.8 to $2.0 \times 10^7$.

Although a larger capacity/output generator or motor tends to be larger, using high strength alloy steel as mentioned above enables a compact apparatus, particularly so that the capacity per floor area is 0.08 to 0.12 $m^2$ per 1 MVA of the capacity. Consequently, energy loss decreases and efficiency rises. Further, the stator current can be reduced relative to capacity, particularly so that the current is 19.0 to 24 A per 1 MVA of generator or motor capacity. Against the capacity of 2,000 MVA, it is possible to reduce the current to 19.0 to 20.0 A. At that time, the rotor is cooled by hydrogen. Depending on the output of the generator, hydrogen pressure must be raised, however, that pressure can be set to 0.003 to 0.006kg/cm$^2$ per 1 MVA. Particularly, 0.004 to 0.005 kg/cm$^2$.g is desired.

Such shafts may be for generators or motors. For motors, a synchronous motor, synchronous generator motor and induced synchronous motor are available. The structures of motors and generators are almost the same. Preferably, we use a high speed motor providing a rotation speed of more than 5,000 rpm.

The tensile strength of the rotor shaft is desired to be more than 93 kg/mm$^2$ or more preferably more than 100kg/mm$^2$ and particularly it is desirable to adjust the composition so as to obtain more than 104 kg/mm$^2$. At the same time, 50% fracture appearance transition temperature is desired to be less than 0° C. and more preferably, less than −20° C. The crystal grain size number is desired to be more than 4 (ASTM crystal grain size). Additionally, as magnetic characteristic, magnetic field strength is desired to be less than 990 AT/cm at 21 kG in magnetic flux density, and less than 400 AT/cm at 20kG. More preferably it is desired to be less than 500 AT/cm in the former condition.

DESCRIPTION OF THE PREFERRED EMBODIMENTS

Embodiments are now described specifically, by way of example.

Embodiment 1

Table 1 shows the chemical composition of various specimen steels. A 20kg ingot is made in a high frequency induction melting furnace and forged to 30 mm in thickness and 90 mm in width at 850° to 1,150° C. Specimens No.2 to 6 and 15 are materials embodying the invention. Others are for comparison. No.1 is a material equivalent to ASTM standard A469-88 class 8 for generator rotor shaft material. No. 5 is a material containing relatively high Al content. These specimens underwent heat treatment by simulating the conditions for the large size rotor shaft centre of a large capacity generator. First, it was heated to 840° C. to form austenite structure and cooled at the speed of 100° C./hour to harden. Then, the specimen was heated and held at 575° to 590° C. for 32 hours and cooled at a speed of 15° C./hour. Tempering was done at such a temperature to secure tensile strength in the range of 100 to 105 kg/mm$^2$ for each specimen.

No.7 to 12 are also steels for comparison. They were heated and held at 820° C. for 16 to 34 hours, quenched at a speed of 100° C./hour, then heated and held at 625° to 635° C. for 40 to 50 hours for tempering, and cooled in the furnace at a speed of 15° C./h.

No.13 and 14 are further steels for comparison. After homogenizing annealing at 900° C. for 2 hours, they were austenitized at 850° C. for 2 hours, hardened by cooling at the speed of 120° C./hour, further tempered at 575° C. for 60 hours, and cooled at a speed of 40° C./hour.

TABLE 1

| Specimen No. | Composition (wt %) | | | | | | | | | | | | | | | |
|---|---|---|---|---|---|---|---|---|---|---|---|---|---|---|---|---|
| | C | Si | Mn | Ni | Cr | Mo | V | Al | P | S | Sn | Sb | As | X[1)] | $\overline{H}$[2)] (X10$^{-4}$) | Ni/Cr |
| 1 | 0.24 | 0.18 | 0.49 | 3.50 | 1.65 | 0.42 | 0.13 | 0.009 | 0.009 | 0.010 | 0.006 | 0.002 | 0.009 | 0.0360 | 64.8 | 2.12 |
| 2 | 0.25 | 0.04 | 0.16 | 3.77 | 2.10 | 0.43 | 0.13 | 0.004 | 0.007 | 0.006 | 0.004 | 0.0007 | 0.003 | 0.0207 | 8.28 | 1.80 |
| 3 | 0.26 | 0.04 | 0.15 | 3.78 | 2.41 | 0.43 | 0.13 | 0.004 | 0.007 | 0.005 | 0.003 | 0.0005 | 0.003 | 0.0185 | 7.40 | 1.57 |
| 4 | 0.26 | 0.04 | 0.15 | 4.15 | 2.35 | 0.45 | 0.14 | 0.003 | 0.008 | 0.005 | 0.004 | 0.0007 | 0.004 | 0.0217 | 8.68 | 1.77 |
| 5 | 0.25 | 0.05 | 0.17 | 3.70 | 2.07 | 0.41 | 0.12 | 0.015 | 0.008 | 0.006 | 0.003 | 0.0008 | 0.005 | 0.0228 | 11.4 | 1.48 |
| 6 | 0.27 | 0.03 | 0.15 | 3.81 | 2.11 | 0.43 | 0.12 | 0.002 | 0.007 | 0.006 | 0.004 | 0.0005 | 0.003 | 0.0205 | 6.15 | 1.81 |
| 7 | 0.20 | 0.02 | 0.24 | 3.62 | 0.39 | 0.25 | 0.09 | | 0.005 | 0.010 | | | | | | 9.28 |
| 8 | 0.23 | 0.05 | 0.33 | 3.42 | 0.18 | 0.26 | 0.12 | | 0.004 | 0.007 | | | | | | 19.0 |
| 9 | 0.24 | 0.06 | 0.29 | 3.64 | 0.25 | 0.34 | 0.12 | 0.005 | 0.006 | 0.006 | 0.003 | 0.0025 | 0.004 | 0.0265 | 15.9 | 14.56 |
| 10 | 0.24 | 0.05 | 0.36 | 3.82 | 0.23 | 0.36 | 0.11 | | 0.005 | 0.006 | | | | | | 16.61 |
| 11 | 0.26 | 0.05 | 0.27 | 2.99 | 1.47 | 0.35 | 0.13 | | 0.007 | 0.011 | | | | | | 2.03 |
| 12 | 0.25 | 0.03 | 0.31 | 2.98 | 1.34 | 0.35 | 0.12 | | 0.005 | 0.008 | | | | | | 2.22 |
| 13 | 0.16 | 0.13 | 0.23 | 2.60 | 1.73 | 0.30 | 0.03 | | 0.008 | 0.012 | | 0.0029 | 0.009 | | | 1.50 |
| 14 | 0.18 | 0.16 | 0.23 | 3.77 | 1.57 | 0.30 | 0.07 | | 0.008 | 0.014 | | 0.0034 | 0.0114 | | | 2.40 |
| 15 | 0.23 | 0.02 | 0.15 | 4.15 | 2.05 | 0.39 | 0.09 | 0.002 | 0.006 | 0.004 | 0.004 | 0.0011 | 0.003 | 0.0181 | 3.62 | 2.02 |

[1)] X is total quantity of P, S, Sn, Sb and As.
[2)] H is quantity of Si multiplied by the X.

None of No.2 to 6 and 15 of the Ni—Cr—Mo—V steel contains proeutectoid ferrite. They possess uniform tempered bainite structure. Every crystal grain size No. of original austenite grains is 7. No.1, 5 and 14 of other alloy also have uniform tempered bainite structure. In No.13, about 5% proeutectoid ferrite is found.

Table 2 shows the results of tensile tests, impact tests, magnetic characteristic and electric characteristic tests. The magnetic field strengths in the Table were obtained under 20 kG and 21 kG. The data shown in the Table are those under 21 kG.

TABLE 2

| Specimen Steel No. | Tensile Strength (kg/mm$^2$) | 0.2% yield Strength (kg/mm$^2$) | Elongation (%) | Reduction of Area (%) | FATT (°C.) | Magnetic Field Strength (AT/cm) | Electric Resistance (cm) |
|---|---|---|---|---|---|---|---|
| 1 | 96 | 78.0 | 18.1 | 61.3 | +30 | 992 | 30.21 |
| 2 | 105 | 80.5 | 22.0 | 67.0 | −50 | 270 | 31.81 |
| 3 | 102 | 79.6 | 22.3 | 69.1 | −65 | 355 | 32.70 |
| 4 | 101 | 78.9 | 23.1 | 70.0 | −74 | 384 | 32.98 |
| 5 | 103 | 80.1 | 20.1 | 63.9 | +3 | 682 | 31.64 |
| 6 | 102 | 79.8 | 22.5 | 67.8 | −63 | 265 | 31.89 |
| 7 | 70.7 | — | — | — | 15 | 202 | — |
| 8 | 68.9 | — | — | — | — | 270 | — |
| 9 | 75.8 | — | — | — | 10 | 281 | — |

TABLE 2-continued

| Specimen Steel No. | Tensile Strength (kg/mm²) | 0.2% yield Strength (kg/mm²) | Elongation (%) | Reduction of Area (%) | FATT (°C.) | Magnetic Field Strength (AT/cm) | Electric Resistance (cm) |
|---|---|---|---|---|---|---|---|
| 10 | 77.0 | — | — | — | −3 | 343 | — |
| 11 | 78.8 | — | — | — | — | 332 | — |
| 12 | 79.0 | — | — | — | −32 | 346 | — |
| 13 | 87.5 | 74.5 | 22.1 | 62.7 | 31 | 859 | — |
| 14 | 90.6 | 78.0 | 23.6 | 63.8 | −15 | 882 | — |
| 15 | 101 | 79.1 | 22.4 | 71.5 | −53 | 221 | 32.56 |

As shown in Table, the low alloy steels No.2 to 4, 6 and 15 have a high strength and toughness while the tensile strength is more than 100 kg/mm², 0.02% yield strength is more than 78 kg/mm² and 50% fracture appearance transition temperature is far below 0° C. or below −50° C. Further, the magnetic field strength satisfies the requirement of less than 990 AT/cm as the magnetic field strength at 21 kG requested for generator rotor shaft over 900 MVA, and the electric resistance is over 30μ-Ωcm because of high Cr content, so that this material is very useful as the rotor shaft material of a large capacity generator over 900 MVA.

The effects of various constituents are now considered in relation to the specific examples and comparison examples.

FIG. 1 is a diagram showing the influence on the tensile strength of Cr content. The tensile strength increases as the Cr quantity increases, when the Ni quantity is 2.60 to 4.15%. Particularly, when Cr quantity exceeds 1.4%, the tensile strength increases rapidly so that the effect of Cr is large. If the quantity exceeds 2.0%, a high tensile strength over 100 kg/mm² can be obtained.

Figure 2:
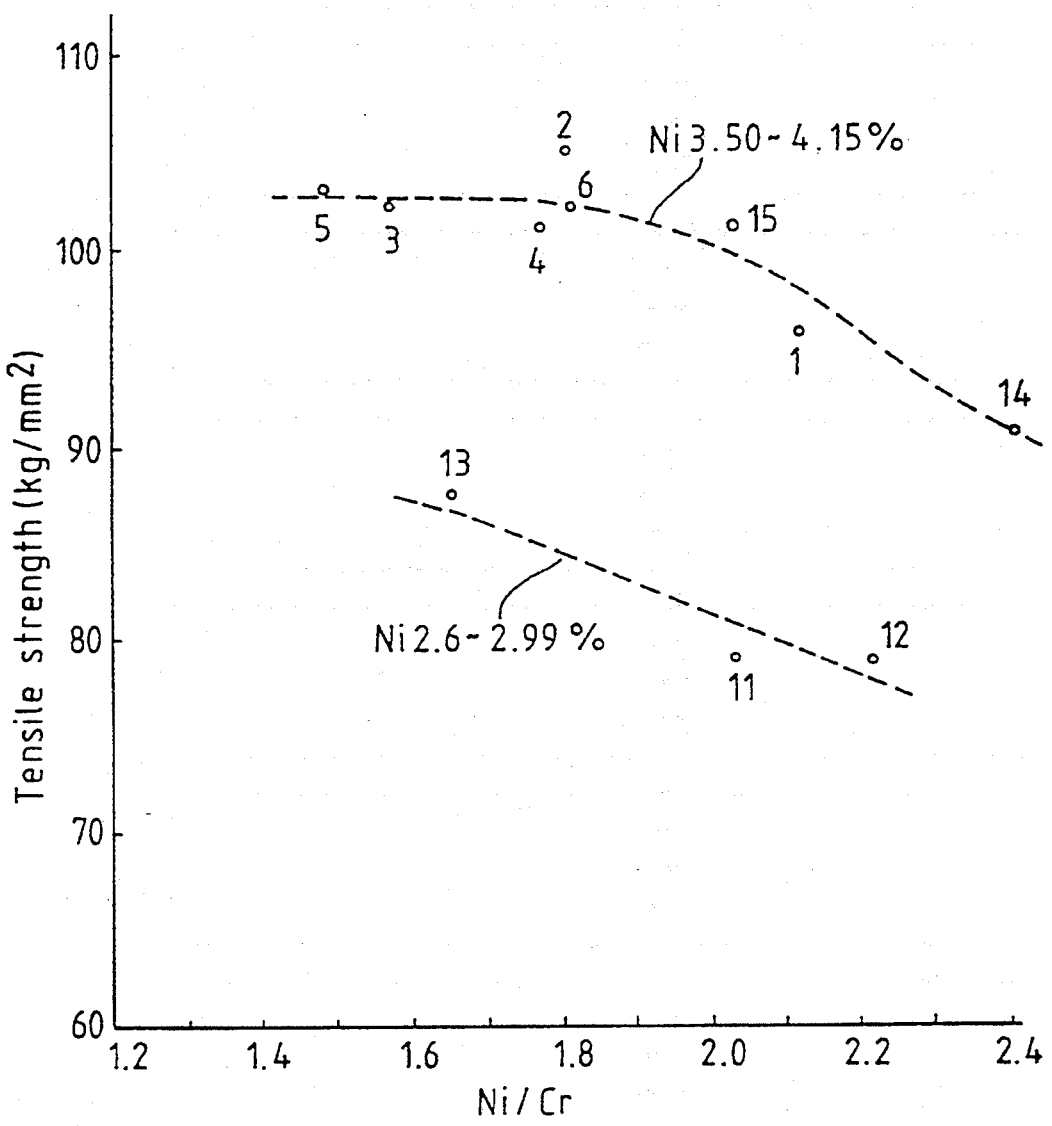
FIG. 2 is a graph showing a relationship between tensile strength and ratio of nickel to chromium.

FIG. 2 is a diagram showing the relationship with Ni/Cr ratio. The tensile strength decreases as Ni/Cr ratio increases. Particularly, a higher strength is obtained by setting the Ni/Cr ratio lower than 2.1. While related to Ni quantity, a far higher strength over 100 kg/mm² is obtained by securing a high Ni quantity over 3.50%. This is obtained by setting Ni/Cr ratio below 2.3 and Ni below 3.5% against the objective tensile strength of 93kg/mm². In this case, if Ni is less than 3%, that tensile strength is difficult to obtain.

Figure 3:
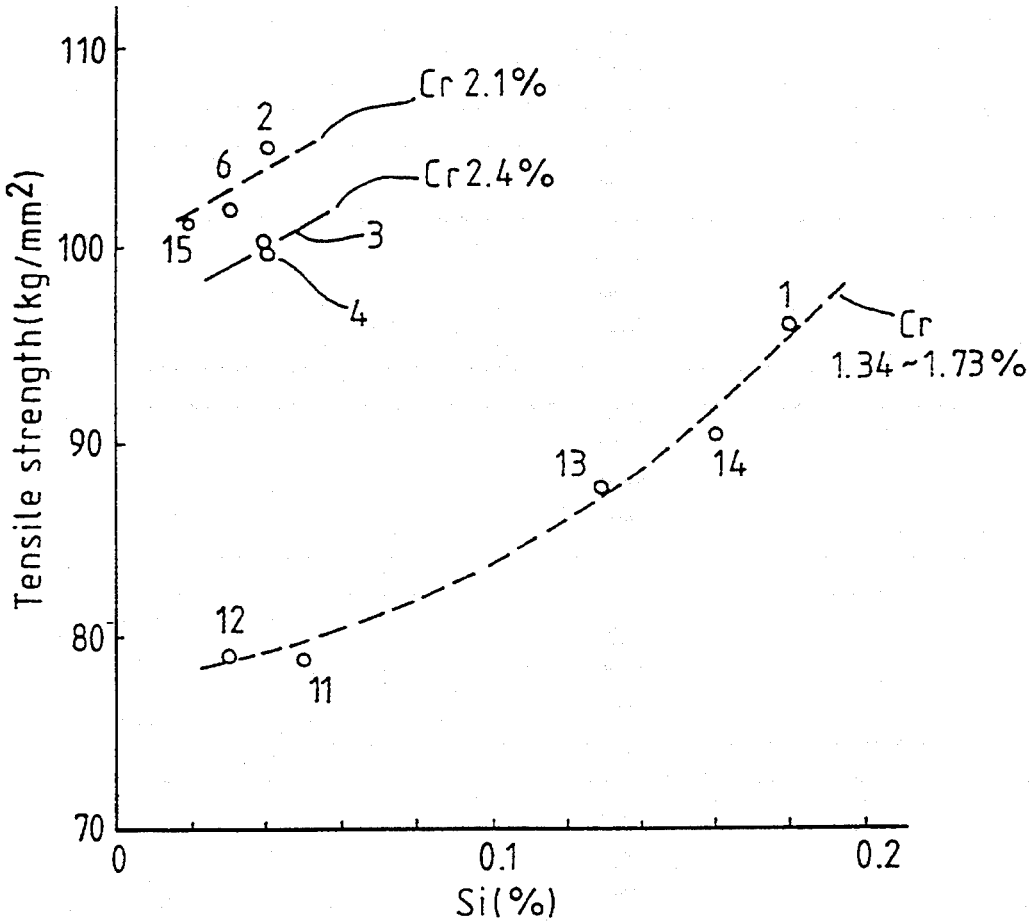
FIG. 3 is a graph showing a relationship between tensile strength and silicon content.

FIG. 3 shows the relationship with Si quantity, indicating that the strength increases as the Si quantity increases. When Si quantity is more than 0.17%, 93 kg/mm²is obtained by adjusting Cr and Ni to 1.3 to 1.8% and 2.6 to 3.5% respectively, while if Cr exceeds 2%, when Si is as low as or less than 0.1%, more than 93 kg/mm² or particularly more than 100 kg/mm² is obtained.

Figure 4:
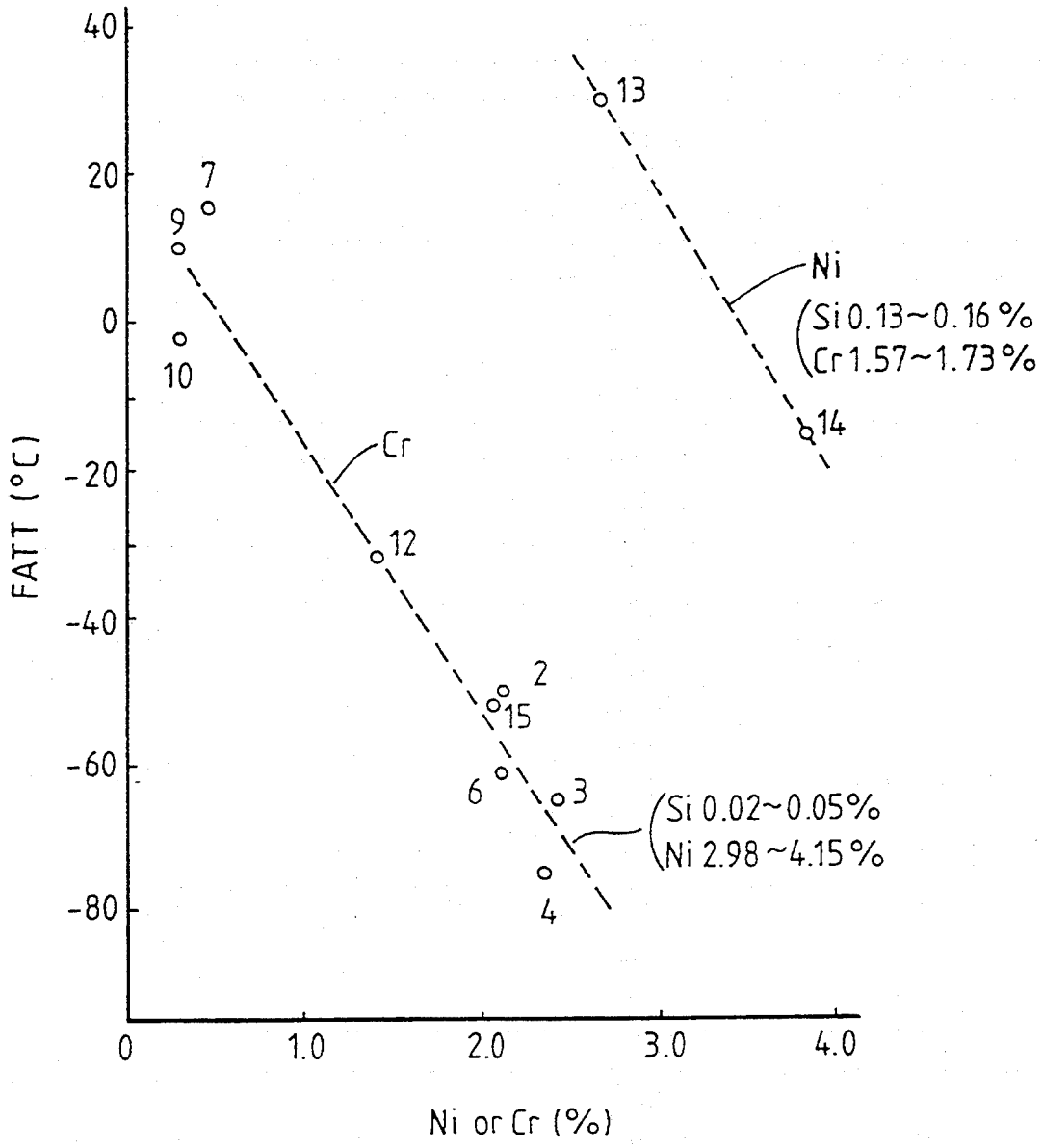
FIG. 4 is a graph showing a relation between FATT, nickel content and chromium content.

FIG. 4 is a diagram shown in the influence on 50% fracture appearance transition temperature of Ni or Cr contents. As the content of Ni or Cr increases, FATT lowers, and particularly, when Si is less than 0.1%, FATT below 0° C. is obtained by making more than 0.5% Cr contained.

Figure 5:
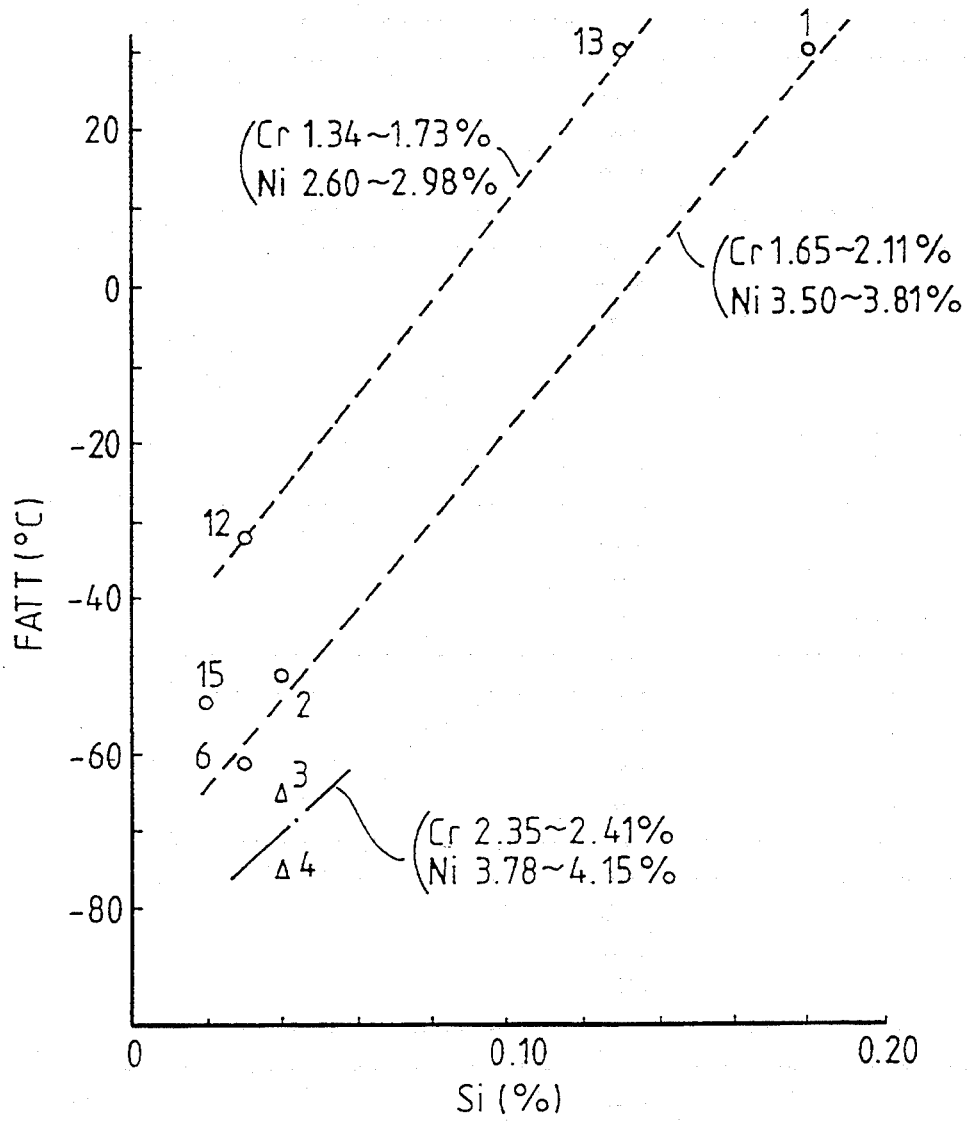
FIG. 5 is a graph showing a relationship between FATT and silicon content.

FIG. 5 is a diagram showing the influence on FATT of Si quantity. As Si quantity decreases, FATT decreases so as to secure a high toughness. Particularly, when Ni is 2.5 to 3.0% and Cr is 1.3 to 1.8%, FATT can be lowered below 0° C. by adjusting Si quantity to below 0.08%, and when Ni is 3.5 to 4.0% and Cr is 1.5 to 2.2%, the value can be lowered below 0° C. by adjusting Si quantity to below 0.13%. When Cr is over 2.2% and Ni is over 3.5%, FATT can be lowered below 0° C. by adjusting Si quantity less than 0.20%.

Figure 6:
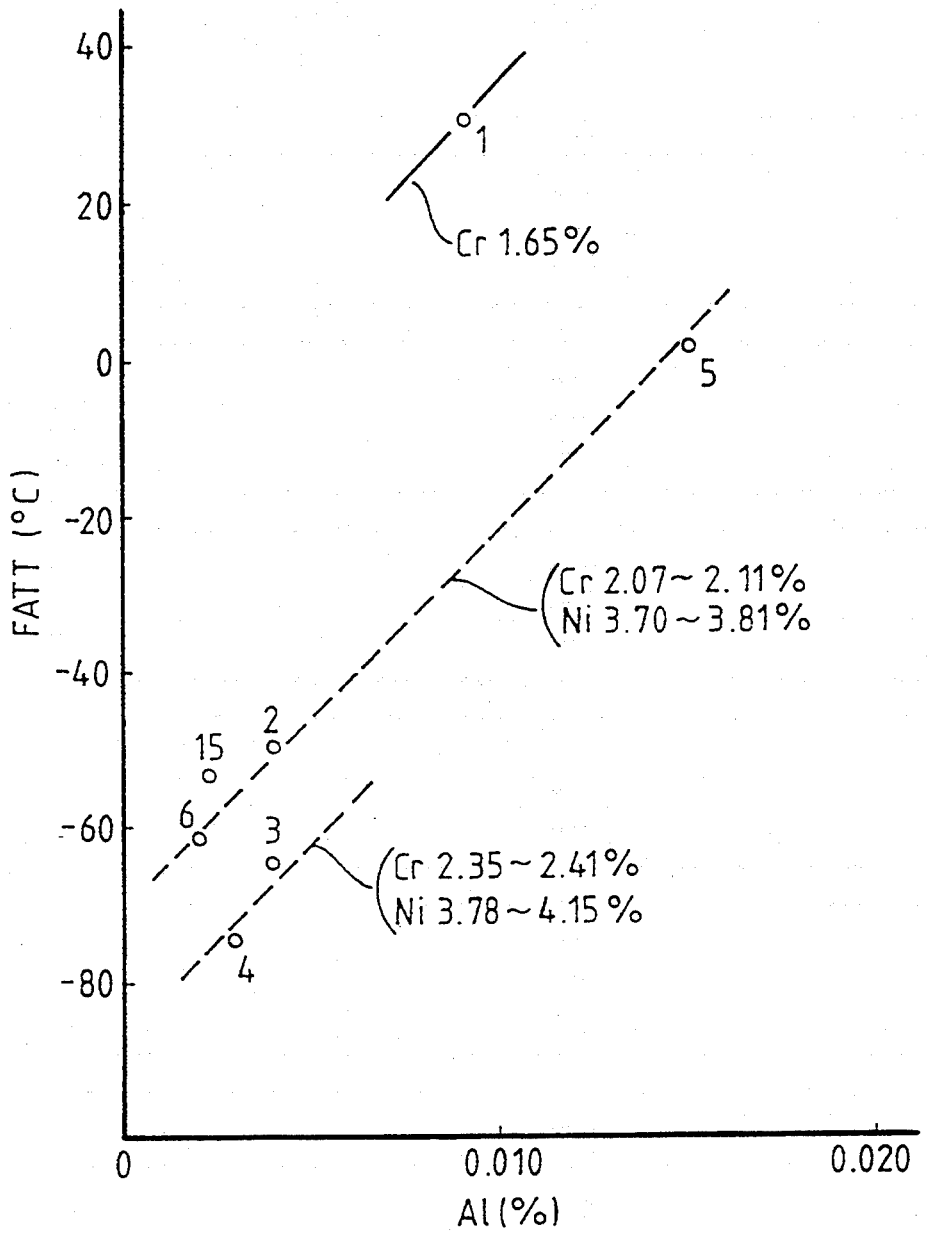
FIG. 6 is a graph showing a relation between FATT and aluminum content.

FIG. 6 is a diagram showing the relationship between FATT and Al content. The Al content increases FATT. When Cr is 2.05 to 2.2% and Ni is 3 to 4%, FATT can be lowered below 0° C. by adjusting Al quantity to below 0.014%. When Cr is 2.2 to 2.5% and Ni is 3.5 to 4.5%, the value can be lowered below 0° C. by adjusting Al quantity to below 0.018%. When Cr is near 1.65%, even if Ni quantity is as high as 3.5%, FATT is difficult to lower below 0° C. if Al quantity is reduced.

Figure 7:
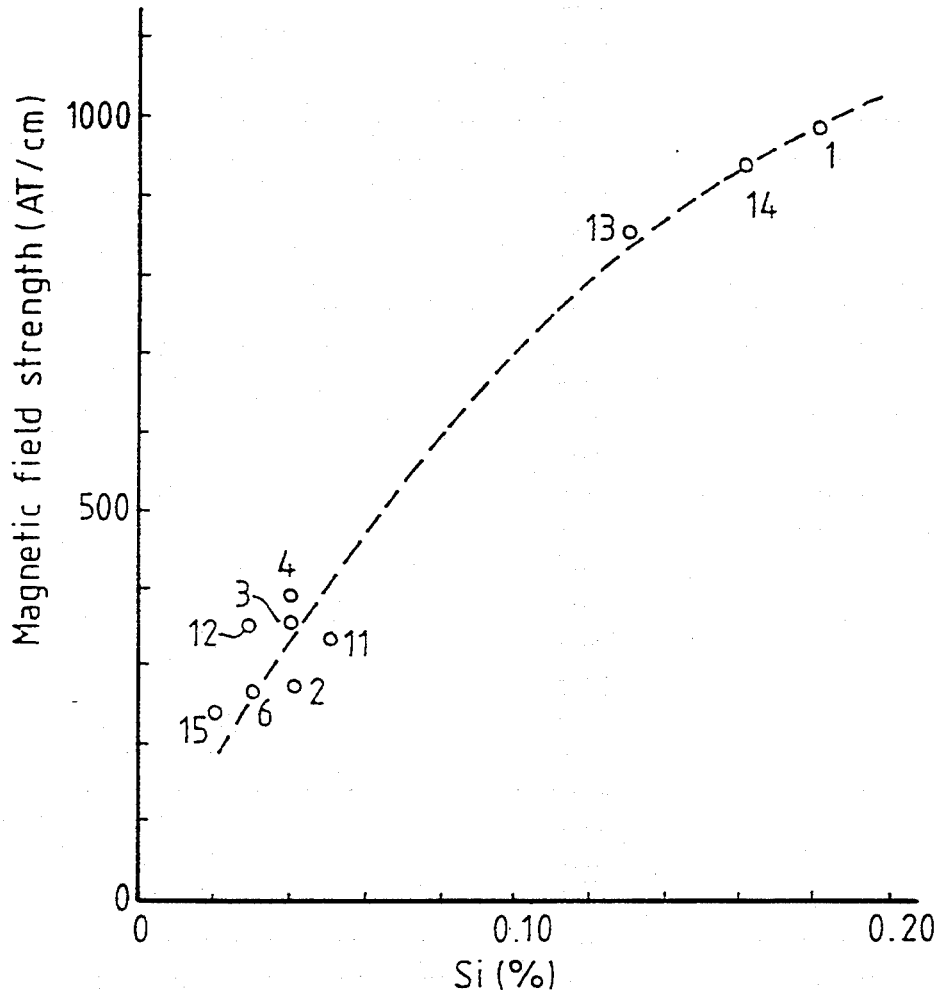
FIG. 7 is graph showing a relation between magnetic properties and silicon content.

FIG. 7 shows the relationship between magnetic field strength and Si quantity. Because the increase of Si quantity intensifies magnetic field strength as shown in the figure, the Si quantity should be as small as possible for present purposes. Particularly, when Cr is 1.5 to 2.5% and Ni is 2.5 to 4.5%, magnetic field strength at 21kG can be suppressed below 990AT/cm by adjusting Si quantity to less than 0.18%. Particularly, when Si quantity is less than 0.1%, a magnetic strength of less than 700 AT/cm is obtained.

Figure 8:
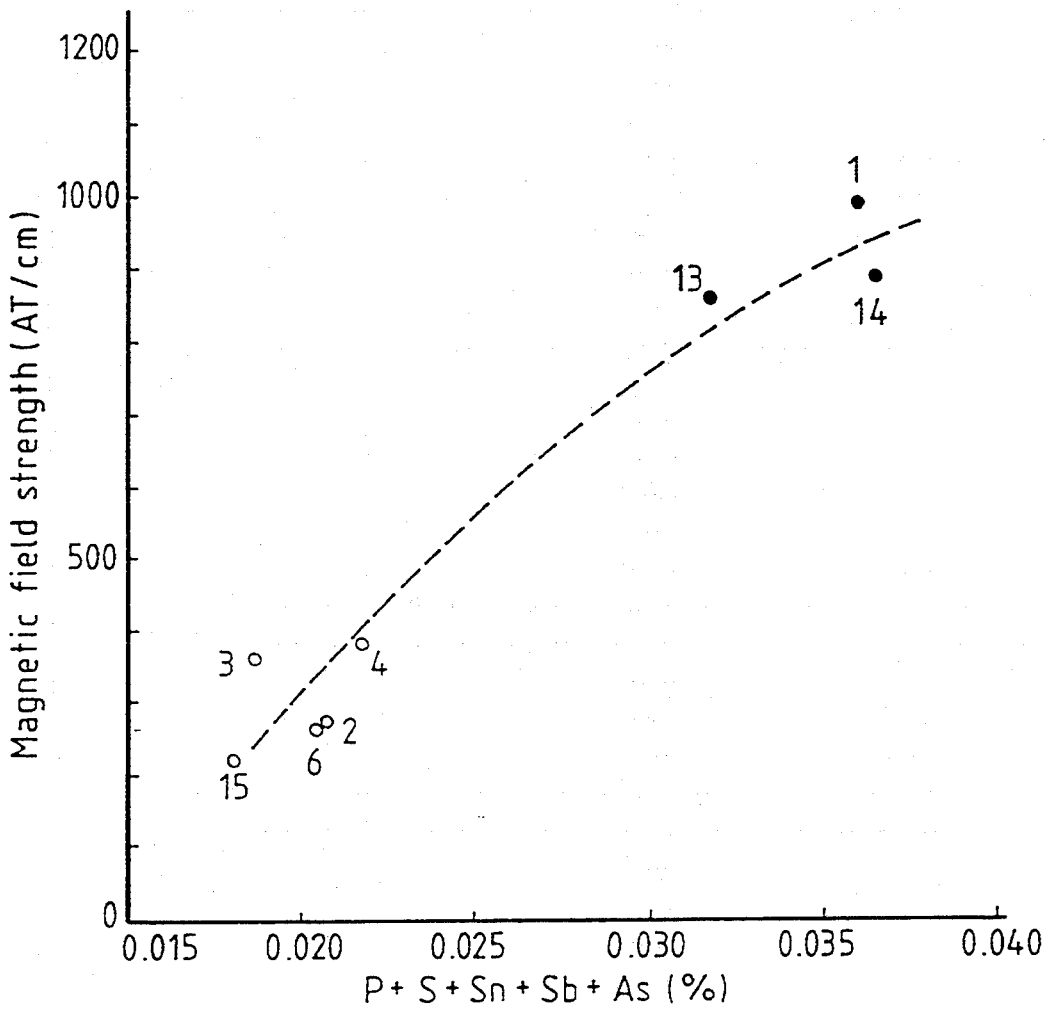
FIG. 8 is a graph showing a relation between magnetic properties and the total content of certain, generally non-metallic, impurities.

FIG. 8 is a diagram showing the relationship between magnetizing force and the total amount of P, S, Sn, Sb and As. These impurities are undesirable because they increase magnetic field strength and their concentration should be less than 0.040% to adjust magnetic field strength below 990 AT/cm. Particularly, it should be less than 0.03% to lower it below 700 AT/cm.

Figure 9:
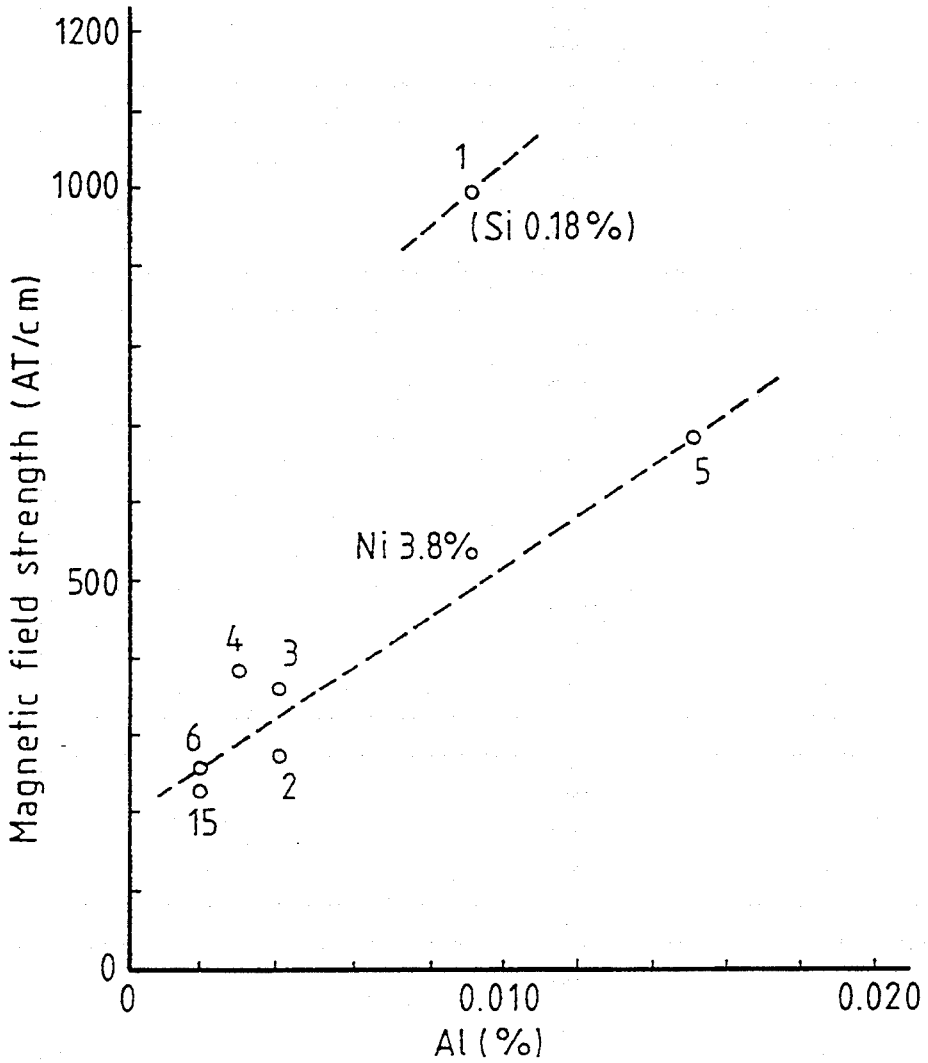
FIG. 9 is a graph showing a relation between magnetic properties and aluminum content.

FIG. 9 shows the relationship between magnetic field strength and Al content. As shown in the figure, Al is undesirable because it intensifies magnetic field strength. When Cr is 1.5 to 2.5% and Ni is 2.5 to 4.5% and even when Si quantities are less than 0.1%, Al quantity should be below 0.025% to obtain a magnetic field strength of less than 990 AT/cm. Particularly, to obtain a magnetic field strength of less than 700 AT/cm, Al quantity should be lowered below 0.015%. If Si quantity exceeds 0.1%, Al quantity should be less than 0.01%.

Figure 10:
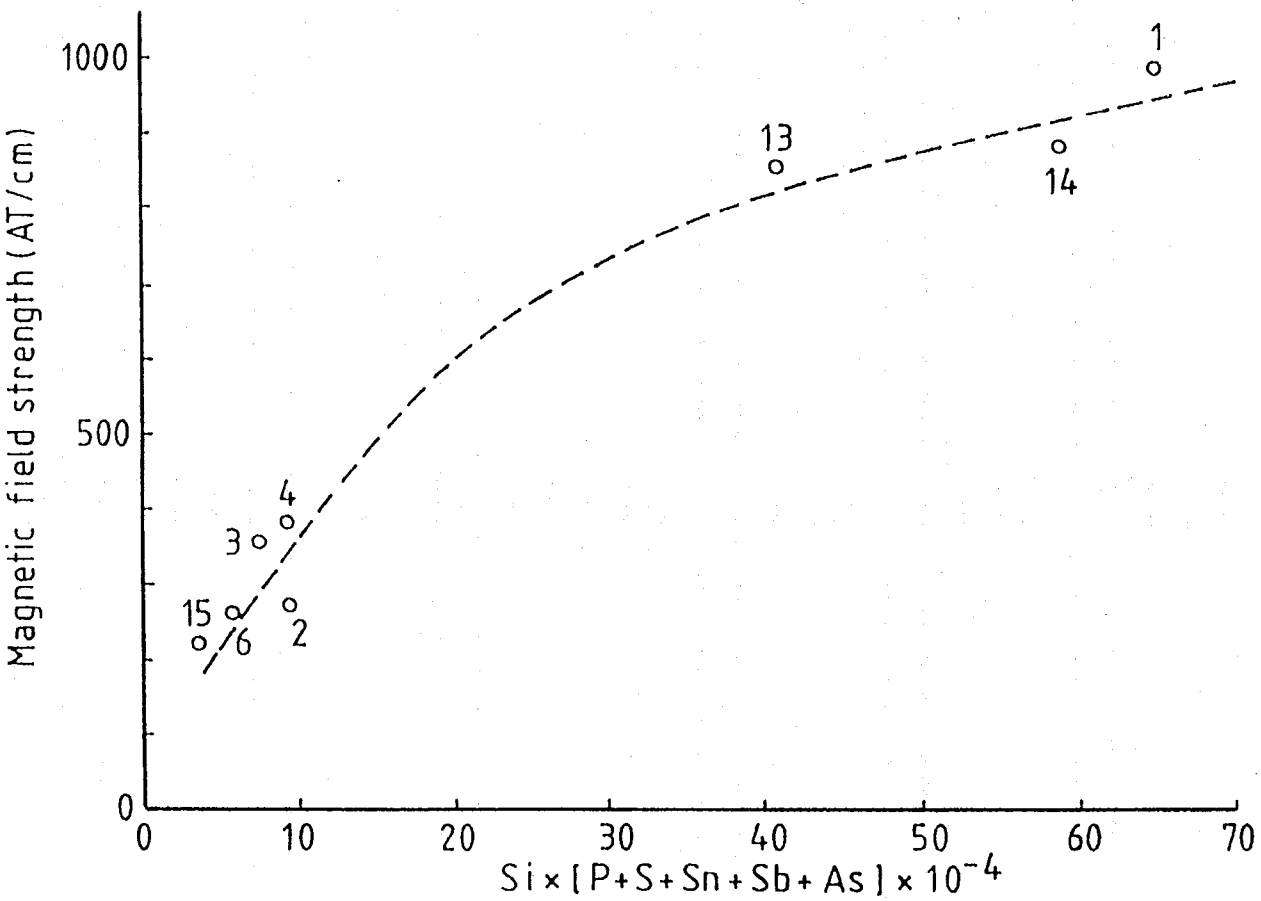
FIG. 10 is a graph showing a relationship between magnetic properties and a parameter which is a product of various impurity contents.

FIG. 10 shows the influence on magnetic field strength of the quantity of Si multiplied by the total amount of P, S, Sn, Sb and Ab and the higher this quantity is, the more inappropriate it is because magnetic field strength is increased. Magnetic field strength can be lowered below 990 AT/cm by adjusting the quantity to less than $70\times10^{-4}$.

Embodiment 2

Table 3 shows the results of the tensile test, impact test and magnetic characteristic test for the specimen provided by intensifying the strength of this invention steel No. 2 to 4 and 6. In this embodiment, the tempering temperature was set 5° C. lower than in Embodiment 1.

As evident from the table, the materials embodying the invention satisfied the mechanical performance and magnetic characteristic required even for 1,200 MVA class and 1,300 MVA class generator rotor shaft, giving tensile strength more than 105 kg/mm$^2$, 0.02% yield strength more than 82 kg/mm$^2$ FATT below −44° C. and magnetic field strength less than 400 AT/cm. Thus these materials can be said to be very useful, e.g. for a >1,200 MVA class large capacity generator rotor shaft.

TABLE 3

| Specimen steel No. | Tensile strength (kg/mm$^2$) | 0.02% yield strength (kg/mm$^2$) | Elongation (%) | Reduction of area (%) | FATT (°C.) | Magnetic field strength (AT/cm) |
|---|---|---|---|---|---|---|
| 2 | 108 | 84 | 22.5 | 64.0 | −44 | 270 |
| 3 | 107 | 83 | 21.4 | 67.1 | −60 | 355 |
| 4 | 105 | 82 | 22.0 | 77.3 | −68 | — |
| 6 | 106 | 83 | 21.5 | 65.2 | −58 | 265 |

Embodiment 3

Thermal power and nuclear power AC turbine generators are usually 2-pole or 4-pole cylindrical rotating field synchronous generators.

Most thermal power turbine generators are 2-pole high-speed generators. The rotation speed is 3,000 rpm at Hz and 3,600 rpm at 60 Hz. This is because the higher the rotation speed, the better the efficiency becomes and the size becomes smaller. In most cases, a tandem compound type generator generating output with a single axis is utilized. Most large capacity machines are of cross compound type, generating output with two axes, which is capable of generating more than the tandem compound type.

The nuclear power turbine generator is usually 4-pole type and used at 1,500 rpm or 1,800 rpm. This is because a larger amount of vapor is generated from the nuclear reactor with a lower temperature and pressure, and the turbine has long blades and rotates at a low speed.

As the cooling method for a turbine generator, indirect cooling method and direct cooling method are available, and air, hydrogen and water are used as cooling medium.

Hydrogen cooling method is used for a large capacity machine and divided into indirect and direct methods. In both cases, an explosion proof sealed structure incorporating a gas cooler in its generator main body is utilized. In case of water cooling type, direct cooling method is used and for a large capacity machine, water cooling method is sometimes used for both the stator and rotor.

Figure 11:
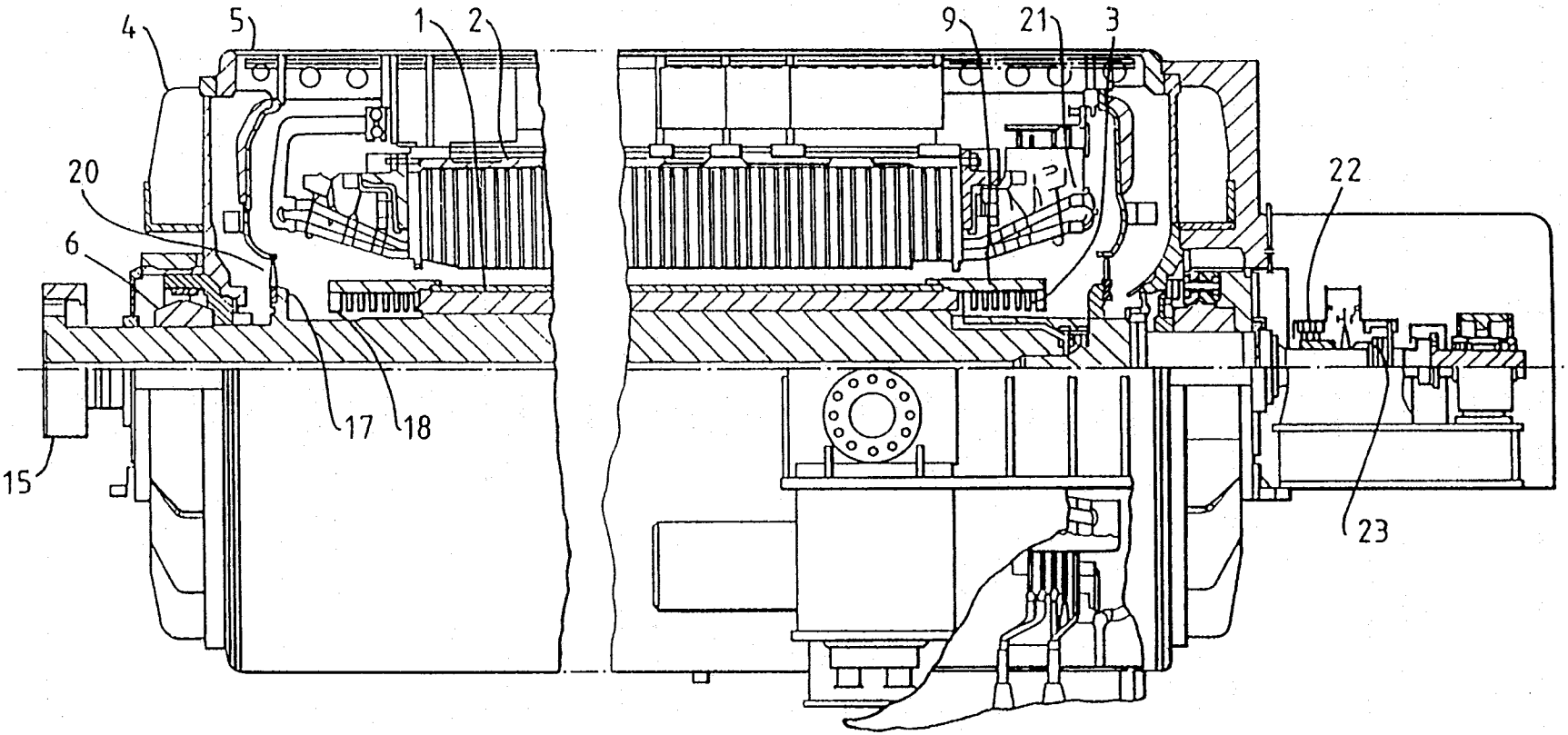
FIG. 11 is a sectional view of a turbine generator.

FIG. 11 shows an example of a stator coil direct water cooling turbine generator, which is an embodiment of an aspect herein.

The stator cage, which is made of welded steel plates, forms an air path, supports the iron core and prevents vibration. The iron core is deformed to an oval shape due to magnetic attraction force, so that double frequency vibration is generated with the rotation of the rotor. Because this vibration increases as with machine size, elastic support structure is adopted by installing the iron core and stator cage through a spring.

0.35 or 0.5 mm thick silicon steel plate is used for the stator iron core 2 and this plate has a directivity. The iron core is formed by laminating by 50 to 60 mm in axial direction and an I-shaped gap steel is inserted to form an air duct.

A two-layer coil is usually used for the stator coil 7, and in case of a 2-pole type, it needs to be held firmly because the coil end is extended. In this case, because the floating load loss increases, a non-magnetic material is used for the structure at the end.

Figure 12:
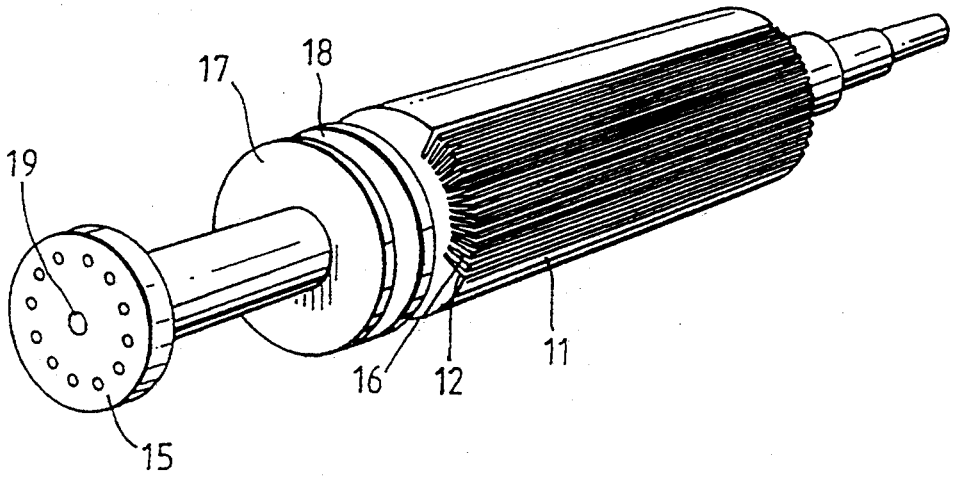
FIG. 12 is a perspective view of a rotor shaft of the generator.
Figure 13:
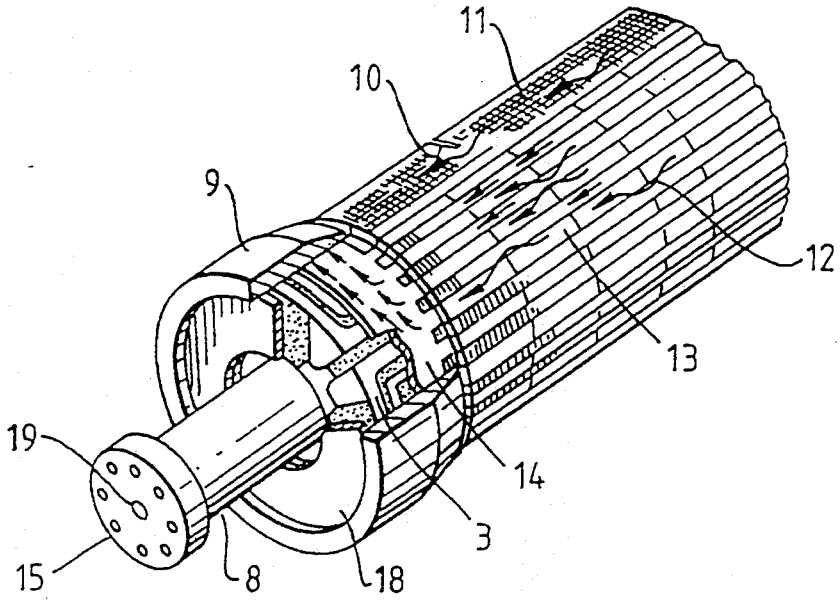
FIG. 13 is a perspective view of the assembled rotor.

The notable characteristic of the turbine generator is that it rotates at a high speed, and the rotor diameter is restricted due to a large centrifugal force. The rotor is forged as one body to secure mechanical strength preventing dangerous speeds and vibrations, and processed to have a slot, in which a field winding coil is incorporated. FIGS. 12 and 13 show the shape of the rotor 1.

The main shaft is made of Ni—Cr—Mo—V steel, preferably of a type as described above. Although not illustrated, the fixing ring 17 for the fan 20 is provided between the flange 15 and centering ring 18.

The field winding coil 3 is distributed and wound in the slots of a rotor iron core between the teeth 12 formed by winding copper belt flat, and a layer insulator is inserted by a single turn of the conductor. The end of the winding coil is held by a retaining ring 9. Usually, a silver contained copper having an excellent creep characteristic is used for the coil instead of copper.

For the retaining ring 9, non-magnetic stainless steel with less than 0.1% C., more than 0.4% N 10–25% Mn and 15–20% Cr is applied. After the winding wire 3 is buried, it is fastened with a wedge 13 made of ultra duralmin alloy. For the end damper ring 14, an end or overall length damper is used, and Al alloy and silver contained copper are used for the end and body respectively. 8 is a shaft, 11 is a magnetic pole and 15 is a coupling.

A large capacity machine over 1,000 MVA is difficult to cool evenly because the iron core is long, so a duplex ventilation method is applied.

According to this method, air supply chambers and exhaust chambers in several sections are arranged alternately within the stator cage in the rear of the iron core, cooling air is collected into each air supply chamber from both ends of the generator through an air duct in the stator cage to cool the stator iron core. Then, this air flows to the outside surface together with the air cooling the inside of the rotor and reaches the suction side through the cooler, circulating inside.

The gas pressure for cooling with hydrogen is 2 atg for indirect hydrogen cooler, and 2 to 5 atg for direct hydrogen cooler. Because when hydrogen gas pressure is increased, the calorific capacity of gas increases in proportion to density as heat transfer rate rises, thus the temperature rise of gas itself decreases in inverse proportion to the absolute pressure of gas so that the effect of cooling increases. Assuming that the output is 100 when 0.05 atg is provided with indirect cooling type, the output from the same dimension machine is 115 under 1 atg, and 125 under 2 atg.

Hydrogen cooling method has a danger of explosion in such a range that hydrogen volume is 10 to 70% when mixed with air. To prevent this accident, hydrogen purity is automatically maintained over 90% and a sealing device to prevent hydrogen gas from leaking outside along the axis by means of oil film is provided inside of the bearing. Gas leakage is prevented by flowing oil having a higher pressure than hydrogen gas inside into the gap on the shaft.

Even when the stator is cooled indirectly in a hydrogen cooling turbine generator, the rotor is often cooled directly.

When the maximum temperature of a generator coil conductor limits the output, the conductor is cooled directly with cooling medium to eliminate the difference of temperature from an insulator occupying a large portion, during a temperature rise.

As cooling media, hydrogen gas, oil and water are available. Water has a heat transfer capacity about 50 times air and excels as a cooling medium.

(1) An example of a hydrogen gas direct cooling stator coil is shown here, and gas is fed inside a square bent tube put between strands to cool the conductor directly. Although part of heat generated in the conductor is transferred to an iron core through a main insulator with a large heat resistance, most is carried away by hydrogen gas via small cooling pipes, with a small heat resistance.

As cooling liquid, pure water having a large specific heat and heat transfer coefficient by convection is utilized.

Stainless steel is applied to pipes serving as a liquid path, and oxygen free copper or deoxidixed copper is used for a coil and clip at the coil end. A PTFE (teflon) tube having a high mechanical strength and flexibility, and an excellent insulation is used for an insulated connecting pipe. The stator coil is hollow in its cross section, where liquid flows.

(2) As the cooling medium for the rotor, hydrogen gas or water is used and the following method is available. According to the end feed method, hydrogen gas, after being forced into the rotor coil from the rotor end, is discharged into the air gap through a hole provided at the center of the rotor. Additionally, the method to introduce hydrogen gas into the coil copper belt from an end of the rotor and discharge it from the other end is also desirable.

As the sectional shape of the rotor coil, either by-pass type or hollow copper type is available. When either type is used, gas direct cooling method is applied for the stator coil also and a high pressure blower is installed on an end of the rotor.

According to the air gap pickup method, a suction hole and discharge hole are provided alternately on the surface of the rotor, and using wind speed by rotation, hydrogen gas at the air gap is sucked from the coil wedge surface, made to flow within the coil copper belt at a specified distance to deprive of generated heat and then discharged to the air gap through the vent hole. Or water is made to flow within a rotating object.

Water cooling method makes the structure more complicated as compared with the hydrogen gas cooling method and thus is disadvantageous in reliability. However, the weight of the generator is 15 to 25% lighter so that the efficiency with partial load can be improved.

In the figure, 15 is a flange connected to the turbine, 20 is a fan, 21 is a stator coil, 22 is a brush and 23 is a spring.

FIG. 12 is a perspective view of a large capacity turbine generator rotor shaft having more than 1,000 MW in turbine output (1,120 MVA in generator capacity) embodying this invention. The rotor shaft embodying this invention was produced as explained below.

To aim at almost the same composition as specimen No. 2 described in embodiment 1, molten metal of about 150 ton, prepared by vacuum ladle refining after melting in the air, was poured into a mold. On the next step, the casting was hot forged by press, upset (forging. ratio: 1/2U) and then lengthened (forging ratio: 3S). Further, after unifying annealing was performed at 900° C., the material was cut to a specified shape, then heated and held at 840° C. in a vertical furnace for 20 hours, and hardened by cooling at the speed of 100° C./hour at the centre hole by water spray. Then, after heating and being held at 580° C. for 60 hours, the material was tempered by cooling at the speed of 15° C./hour. After that, it was cut to the final shape as shown in FIG. 12. This embodiment is for 2-pole type, and 11 is a magnetic pole, 12 is teeth, 17 is fan mounting ring, 18 is retaining ring fitting centering ring, and 19 is center hole. A test piece was collected from this material to inspect its mechanical, electric and magnetic characteristics. The centering ring 18 is integrated on forming the shaft and a retaining ring is shrinkage fit after cutting to ring like shape.

In this embodiment, the overall length is about 15 m, the diameter of the body on which teeth are provided is 1.2 m, and the length of the body is about 7 m, about 5.7 times the diameter of the body. The machine size of this embodiment is about $10m^3$, thus the rotor's sensitivity to vibration is reduced, so that the sensitivity to imbalance in the same phase can be suppressed and at the same time, a high axis stability is obtained because the flexibility of the shaft drops.

The machine size is expressed by (outside diameter of the rotor body)$^2\times$(length of the rotor)

The relationship between the machine size of rotor shaft and generator capacity (MVA) is preferably between the ranges expressed by the expressions 1 and 2.

Expression 1

Machine size ($m^3$)$=4.7+3.2\times10^{-3}\times$generator capacity (MVA) . . . (Expression 1)

Expression 2

Machine size ($m^3$)$=4.5+5.7\times10^{-3}\times$generator capacity (MVA) . . . (Expression 2)

The mechanical, magnetic and electric characteristics of this embodiment are the same as the values of the alloy No.2 of the embodiment 1.

The specifications of this embodiment are as follows.

Generator capacity: 1,100 MVA, stator current: 22 A per 1 MVA of generator capacity, power factor: 0.9, rotation speed: 3,600 rpm, frequency: 60 Hz, stator: direct water cooling, rotor: direct hydrogen cooling (0.0047 kg/cm$^2$.g per 1 MVA of generator capacity), casing material: SM41 steel, iron core material: directional silicon steel, coil: electrolytic copper, insulation material: epoxy resin and mica, length and diameter of the part in which a coil is embedded=5.83, retaining material: 18% Mn-18% Cr steel containing C 0.1% or less, more than 0.4% N, Si less than 1%, overall length damper, rotor coil: silver contained copper, bearing: cast carbon steel, overall length: 16 m in length, 6 m in width, floor area: 96 $m^2$.

The above mentioned structure ensures 1,120 MVA of generator capacity against the turbine output of 1,000 MW class and the unit floor area for this generator per 1 MVA is 0.086 $m^2$ or about 13% smaller than the floor area per 1 MVA of the conventional 800 MVA class turbine generator, 0.098 $m^2$. The floor area can be reduced to 0.08 to 0.09 $m^2$ per 1 MVA of generator output.

Concerning the low alloy steel embodying this invention, the upper and lower limit of the body diameter must be a value which can be obtained from the previously mentioned machine size, while the upper limit and lower limit of the diameter D(mm) are desired to be a value which can be obtained from the expressions 3 and 4, respectively. The length of the body is desired to be 5.5 to 6.5 times the diameter.

Expression 3

Diameter of the body D (mm)=0.2×generator capacity (MVA)+1000 . . . (Expression 3)

Expression 4

Diameter of the body D (mm)=0.2×generator capacity (MVA)+900 . . . (Expression 4)

The structure as described makes it possible to reduce the rotor's sensitivity to vibration and make a compact generator unit.

Because tensile strength is more than 93 kg/$mm^2$, 50% fracture transition temperature is below 0° C. and the magnetizing force at 21 kG is less than 900 AT/cm, a compact large capacity generator of more than 900 MVA in capacity or synchronous motor having a rotation speed of more than 5000 rpm can be produced. Hence, effective use of the installation area is enabled, so that this contributes to diversification of energy including petroleum, coal and nuclear power for power generation.

We claim:

1. An electric rotary machine rotor shaft equipped with a body having a slot in which to embed a coil in an axial direction, and a flange and a bearing for transmitting and receiving power, wherein the shaft is formed of Ni—Cr—Mo—V alloy steel comprising 3 to 5 wt % Ni, 2 to 3.5 wt % Cr, 0.1 to 1.0 wt % Mo and 0.03 to 0.35 wt % V whose tensile strength at room temperature is 93 kg/$mm^2$ or more, whose 50% fracture appearance transition temperature is less than 0° C. and whose magnetic susceptibility at 21.2 kG and 20.2 kG is less than 985 AT/cm and less than 395 respectively; the diameter of said body being more than 1 m and the length of said body being 5.5 to 6.0 times the diameter of said body.

2. An electric rotary machine rotor shaft equipped with a body having a slot in which to embed a coil in an axial direction, and a flange and a bearing for transmitting and receiving power, wherein said shaft is formed of high strength Ni—Cr—Mo—V alloy steel comprising 3 to 5 wt % Ni, 2 to 3.5 wt % Cr, 0.1 to 1.0 wt % Mo and 0.03 to 0.35 wt % V and body diameter is more than 1 m and length of the body is 5.5 to 6.0 times said diameter, and said body diameter D (mm) is less than 0.2 mm per generator output of 1 MVA plus 900 mm and more than 0.2 mm per generator output of 1 MVA plus 1,000 mm.

3. An electric rotary machine rotor shaft equipped with a body having a slot in which to embed a coil in an axial direction, and a flange and a bearing for transmitting and receiving power, wherein said shaft is formed of high strength Ni—Cr—Mo—V alloy steel comprising 3 to 5 wt % Ni, 2 to 3.5 wt % Cr, 0.1 to 1.0 wt % Mo and 0.03 to 0.35 wt % V and body diameter D(m) is more than 1 m and length of the body is 5.5 to 6.0 times said body diameter while said body diameter is set against rotation speed of the shaft so that the value ($D^2 \times R^2$) obtained from the relationship with the rotation speed R(rpm) of the shaft is 1.7 to $3.0 \times 10^8$.

4. An electric rotary machine rotor shaft comprising a solid shaft formed of high strength, high toughness Ni—Cr—Mo—V alloy steel comprising 3 to 5 wt % Ni, 2 to 3.5 wt % Cr, 0.1 to 1.0 wt % Mo and 0.03 to 0.35 wt % V whose tensile strength at room temperature is more than 93 Kg/$mm^2$, whose 50% fracture appearance transition temperature is less than −60° C. and whose magnetic susceptibility at 21.2 kG and 20.2 kG is less than 985 AT/cm and less that 395 AT/cm, respectively.

5. A large capacity electric rotary machine outputting more than 1,000 MVA, equipped with a stator constituted of a laminated iron core in which a coil is embedded and a rotor rotating within the stator, wherein the shaft of said rotor is formed of high strength Ni—Cr—Mo—V low alloy steel comprising 3 to 5 wt % Ni, 2 to 3.5 wt % Cr, 0.1 to 1.0 wt % Mo and 0.03 to 0.35 wt % V and includes a coil, the diameter of the shaft is more than 1 m, the length of the shaft is 5.5 to 6.0 times the diameter and the floor area required for the installation is 0.08 to 0.09 $m^2$ per 1 MVA.

6. A large capacity electric rotary machine outputting more than 1,000 MVA and equipped with a rotor shaft and stator, wherein the stator current is 19.0 to 22.5 A per 1 MVA of the output while the stator is directly water cooled, the rotor shaft is cooled by hydrogen pressure of 0.003 to 0.005 kg/cm2.g per 1 MVA and the rotor shaft is formed of high strength Ni—Cr—Mo—V alloy steel comprising 3 to 5 wt % Ni, 2 to 3.5 wt % Cr, 0.1 to 1.0 wt % Mo and 0.03 to 0.35 wt % V and has a diameter of more than 1.15 m.

7. An electric rotary machine rotor shaft equipped with a body having a slot in which to embed a coil in an axial direction, and a flange and a bearing for transmitting and receiving power, wherein the shaft is formed of forged Ni—Cr—Mo—V alloy steel having substantially entire bainite structure, whose tensile strength at room temperature is 93 kg/$mm^2$ or more, whose 50% fracture appearance transition temperature is less than 0° C. and whose magnetic susceptibility at 21.2 kG and 20.2 kG is less than 985 AT/cm and less than 395 AT/cm, respectively, the diameter of said body being more than 1 m and the length of said body being 5.5 to 6.0 times the diameter of said body; said forged Ni—Cr—Mo—V alloy steel comprising 0.15 to 0 3 wt % C, less than 0.1 wt % Si, less than 1 wt % Mn, 3 to 5 wt % Ni, 2 to 3.5 wt % Cr, 0.1 to 1.0 wt % Mo and 0.03 to 0.35 wt % V.

8. An electric rotary machine rotor shaft equipped with a body having a slot in which to embed a coil in an axial direction, and a flange and a bearing for transmitting and receiving power, wherein the shaft is formed of forged Ni—Cr—Mo—V alloy steel having substantially entire bainite structure, whose tensile strength at room temperature is 93 kg/$mm^2$ or more, whose 50% fracture appearance transition temperature is less than 0° C. and whose magnetic susceptibility at 21.2 kG and 20.2 kG is less than 985 AT/cm and less than 395 AT/cm, respectively, the diameter of said body being more than 1 m and the length of said body being 5.5 to 6.0 times the diameter of said body; said forged Ni—Cr—Mo—V alloy steel comprising 0.15 to 0.3 wt % C, less than 0.1 wt % Si, less than 1 wt % Mn, 3 to 5 wt % Ni, 2 to 3.5 wt % Cr, 0.1 to 1.0 wt % Mo and 0.03 to 0.35 wt % V.

9. An electric rotary machine rotor shaft equipped with a body having a slot in which to embed a coil in an axial direction, and a flange and a bearing for transmitting and receiving power, wherein the shaft is formed of high strength forged Ni—Cr—Mo—V alloy steel having substantially entire bainite structure, whose tensile strength at room temperature is 93 kg/$mm^2$ or more, whose 50% fracture appearance transition temperature is less than 0° C. and whose magnetic susceptibility at 21.2 kG and 20.2 kG is less than 985 AT/cm and less than 395 AT/cm, respectively, the diameter of said body being more than 1 m and the length of said body being 5.5 to 6.0 times said diameter, while said body diameter is set against rotation speed of the shaft so that the value ($D^2 \times R^2$) obtained from the relationship with the rotation speed R (rpm) of the shaft is 1.7 to $3.0 \times 10^8$; said forged Ni—Cr—Mo—V alloy steel comprising 0.15 to 0.3 wt % C, less than 0.1 wt % Si, less than 1 wt % Mn, 3 to 5 wt % Ni, 2 to 3.5 wt % Cr, 0.1 to 1.0 wt % Mo and 0.03 to 0.35 wt % V.

10. An electric rotary machine rotor shaft comprising a solid shaft formed of high strength, high toughness forged Ni—Cr—Mo—V alloy steel having substantially entire bainite structure, whose tensile strength at room temperature is 93 kg/mm$^2$ or more, whose 50% fracture appearance transition temperature is less than −60° C. and whose magnetic susceptibility at 21.2 kG and 20.2 kG is less than 985 AT/cm and less than 395 AT/cm, respectively; said forged Ni—Cr—Mo—V alloy steel comprising 0.15 to 0.3 wt % C, less than 0.1 wt % 0.1 Si, less than 1 wt % Mn, 3 to 5 wt % Ni, 2 to 3.5 wt % Cr, 0.1 to 1.0 wt % Mo and 0.03 to 0.35 wt % V.

11. A large capacity electric rotary machine outputting more than 1,000 MVA, equipped with a stator constituted of a laminated iron core in which a coil is embedded and a rotor rotating within the stator, wherein the shaft of said rotor is formed of high strength forged Ni—Cr—Mo—V low alloy steel having substantially entire bainite structure, whose tensile strength at room temperature is 93 kg/mm$^2$ or more, whose 50% fracture appearance transition temperature is less than 0° C. and whose magnetic susceptibility at 21.2 kG and 20.2 kG is less than 985 AT/cm and less than 395 AT/cm, respectively, and includes a coil, the diameter of the shaft is more than 1 m, the length of the shaft is 5.5 to 6.0 times the shaft diameter and the floor area required for the installation is 0.08 to 009 m$^2$ per 1 MVA; said forged Ni—Cr—Mo—V alloy steel comprising 0.15 to 0.3 wt % C, less than 0.1 wt % Si, less than 1 wt % Mn, 3 to 5 wt % Ni, 2 to 3.5 wt % Cr, 0.1 to 1.0 wt % Mo and 0.03 to 0.35 wt % V.

12. A large capacity electric rotary machine outputting more than 1,000 MVA and equipped with a stator and a rotor shaft, wherein the stator current is 19.0 to 22.5 A per 1 MVA of the output while the stator is directly water cooled, the rotor shaft is cooled by hydrogen pressure of 0.003 to 0.005 kg/cm$^2$.g per 1 MVA and the rotor shaft is formed of high strength forged Ni—Cr—Mo—V alloy steel having substantially entire bainite structure, whose tensile strength at room temperature is 93 kg/mm$^2$ or more, whose 50% fracture appearance transition temperature is less than 0° C. and whose magnetic susceptibility at 21.2 kG and 20.2 kG is less than 985 AT/cm and less than 395 AT/cm, respectively, and has a diameter of more than 1.15 m; said forged Ni—Cr—Mo—V alloy steel comprising 0.15 to 0.3 wt % C, less than 0.1 wt % Si, less than 1 wt % Mn, 3 to 5 wt % Ni, 2 to 3.5 wt % Cr, 0.1 to 1.0 wt % Mo and 0.03 to 0.35 wt % V.

* * * * *